United States Patent [19]

Broeders

[11] Patent Number: 5,074,627

[45] Date of Patent: Dec. 24, 1991

[54] ANTI-TILT AND LOCKING MECHANISM FOR MULTI-DRAWER CABINETS

[75] Inventor: Nicholas Broeders, Downsview, Canada

[73] Assignee: Reff Incorporated, Weston, Canada

[21] Appl. No.: 552,384

[22] Filed: Jul. 13, 1990

[51] Int. Cl.[5] ..... E04C 7/06

[52] U.S. Cl. ..... 312/221; 312/218

[58] Field of Search ..... 312/107.5, 216, 218, 312/221, 217, 220; 292/DIG. 3

[56] References Cited

U.S. PATENT DOCUMENTS

| | | | |
|---|---|---|---|
| 3,454,320 | 7/1969 | Olree | 312/221 |
| 3,874,755 | 4/1975 | Hegg et al. | 312/221 |
| 3,881,793 | 5/1975 | Anderson | 312/217 |
| 3,900,236 | 8/1975 | Goulish et al. | 312/217 |
| 3,909,090 | 9/1975 | Breckner et al. | 312/217 |
| 4,272,138 | 6/1981 | Stark | 312/221 |
| 4,298,236 | 11/1981 | Laroche | 312/215 |
| 4,355,851 | 10/1982 | Slusser | 312/215 |
| 4,429,930 | 2/1984 | Blouin | 312/216 |
| 4,480,883 | 11/1984 | Young | 312/220 |
| 4,838,624 | 6/1989 | Walla | 312/221 |
| 4,865,404 | 9/1989 | Harper | 312/221 |
| 4,936,640 | 6/1990 | Pratzer | 312/221 |
| 4,966,423 | 10/1990 | Higuera et al. | 312/221 |

FOREIGN PATENT DOCUMENTS

| | | | |
|---|---|---|---|
| 1037093 | 8/1978 | Canada | 312/81 |
| 1114883 | 12/1981 | Canada | 312/81 |
| 1175875 | 10/1984 | Canada | 312/71 |
| 2341792 | 2/1974 | Fed. Rep. of Germany | 312/217 R |
| 0459641 | 1/1937 | United Kingdom | 312/217 R |

*Primary Examiner*—Kenneth J. Dorner
*Assistant Examiner*—Gerald A. Anderson
*Attorney, Agent, or Firm*—Rogers, Bereskin & Parr

[57] ABSTRACT

An anti-tilt mechanism is provided for a multi-drawer cabinet. The mechanism has a number of housings each of which has a respective locking cam mounted in it. The locking cams are rotatable about respective cam axes from an inactivated position in which they have a first effective height, to an activated position in which they have a second effective height. The second effective height is greater than the first effective height. The cam is longitudinally moveable within the housing a distance generally corresponding into the difference between the first and second effective heights. Actuating means reacting to movement of the drawers are provided for rotating the cam between the activated and inactivated positions. Respective locking rods extend between adjacent locking cams and are longitudinally moveable with the cams. The anti-tilt mechanism may include a locking mechanism having stop means which limit longitudinal movement of at least one of the cams within its respective housing. The stop means are moveable; by a key activated actuating mechanism, between an engaged position interfering with cam movement and a disengaged position not interfering with the cam movement.

14 Claims, 7 Drawing Sheets

ANTI-TILT AND LOCKING MECHANISM FOR MULTI-DRAWER CABINETS

FIELD OF THE INVENTION

This invention relates generally to anti-tip mechanisms for storage cabinets and more particularly to improved anti-tip and locking systems for multi-drawer filing cabinets.

BACKGROUND OF THE INVENTION

An inherent hazard with conventional filing cabinets having a number of horizontally slidable drawers is that if more than one drawer is pulled out at a given time, the cabinets may tip. Accordingly, a number of systems have been developed which prevent the opening of further drawers once a first drawer has been opened.

Some of the earlier systems, for example, those described in U.S. Pat. Nos. 4,480,883 (Young) and 4,298,236 (Laroche) utilize locking cams which are rotatable by the action of an actuator arm from a closed position, wherein they have a first effective height, to an open position wherein they have a second greater effective height. These systems further use vertically slidable locking rods extending between adjacent locking cams and include stop means which limit movement of the locking rods so that only one of the cams may be rotated into the open position at any given time.

In the system disclosed in Young, the locking cams are freely floating between adjacent locking rods and have opposed flanges which engage the locking rods to prevent the locking cams from falling out. A disadvantage with this system is that if any of the locking rods should be separated, for example, if they stick, the locking cams may then come out. A further disadvantage to this system is that dimensional inaccuracies of the components are additive so that actuator arm placement becomes more inaccurate the further up the cabinet one goes. Furthermore, the system disclosed in Young requires that separate upper and lower limits be provided for the locking rods.

In the structure disclosed in the Laroche reference, the locking cams are mounted on fixed pivot axis which are provided by pivot pins extending between the locking rod supporting channel and a bracket attaching to the interior surface of the cabinet and extending across the locking rod supporting channel. As the locking cams in Laroche are not freely floating, Laroche provides a recess in the upper ends of the locking rods which will receive the lower portion of the cam immediately thereabove when the stack of rods is raised. A disadvantage with the Laroche system is that opposite ends of the pin on which the cam pivots attach to different members. Accordingly, if the pin locating holes in either of the members are not accurately placed, the pins will not properly align. Furthermore, it is necessary in assembling the device disclosed in the Laroche reference to provide a pin and furthermore to install each pin individually during the manufacture of the cabinet.

SUMMARY OF THE INVENTION

An anti-tilt mechanism for a multi-drawer cabinet is provided, said mechanism comprising:

a plurality of housings each defining an elongated opening;

a respective locking cam mounted in each said opening and rotatable about a respective cam axis from an inactivated position wherein said cam has a first effective height to an activated position wherein said cam has a second effective height, said cam being displaceable along said opening a predetermined distance limited by the ends of said opening, said predetermined distance corresponding to an integral multiple of the difference between said first and second effective heights;

activating means reacting to movement of the drawers of said multi-drawer cabinet for rotating said cam between said activated and inactivated positions; and, respective locking rods each extending between adjacent pairs of said locking cams and being longitudinally moveable with said cams, said locking rods being dimensioned such that when a number of said locking cams corresponding to said integral number are in their respective activated positions, the remaining of said locking cams are prevented from rotating into their respective activated positions by a combination of the ends of said locking rods and said ends of said openings.

A locking mechanism is also provided for the anti-tilt mechanism, the locking mechanism comprising:

stop means for limiting said displacement of at least one of said cam within its respective housing, said stop means being moveable between and engaged position interfering with said displacement and a disengaged position in which said stop means does not interfere with said displacement; and, stop actuating means removing stop means between said engaged and disengaged positions.

A preferred embodiment of the present invention is described below in conjunction with multi-drawer cabinets having vertically stacked, horizontally slidable drawers. Accordingly, the anti-tilt mechanism is described as being oriented in a generally vertical manner. It is to be appreciated that the structure of the present invention may be adapted to situations where it is required that the structure have a generally horizontal orientation to prevent movement in a generally vertical direction.

DESCRIPTION OF THE DRAWINGS

Preferred embodiments of the present invention will now be described with reference to the drawings in which:

FIG. 1 B is a further perspective view of a filing cabinet;

DESCRIPTION OF A PREFERRED EMBODIMENT

Referring to FIGS. 1A, 1B, 2 and 3, a multi-drawer cabinet is generally indicated by Reference 10. The cabinet has four drawers 12 arranged one above the other. The cabinet has an anti-tilt mechanism 14 mounted adjacent its left hand side 16. It is to be appreciated that the anti-tilt mechanism may be duplicated on the opposite side of the cabinet.

Figure 1A:
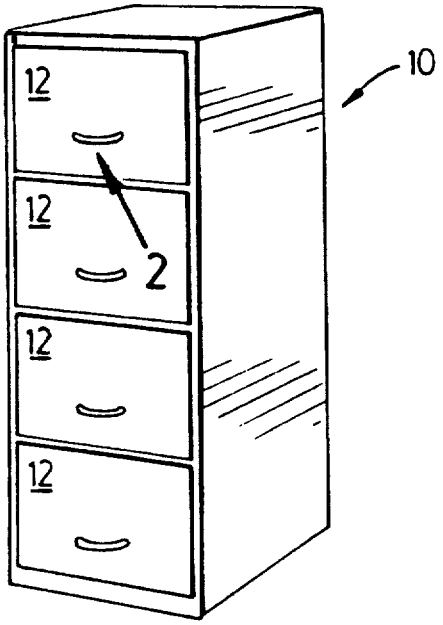
FIG. 1 A is a perspective view of a filing cabinet.
Figure 1B:
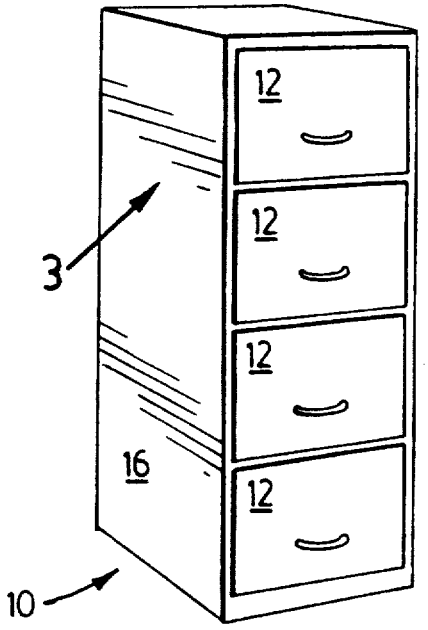
Figure 4:
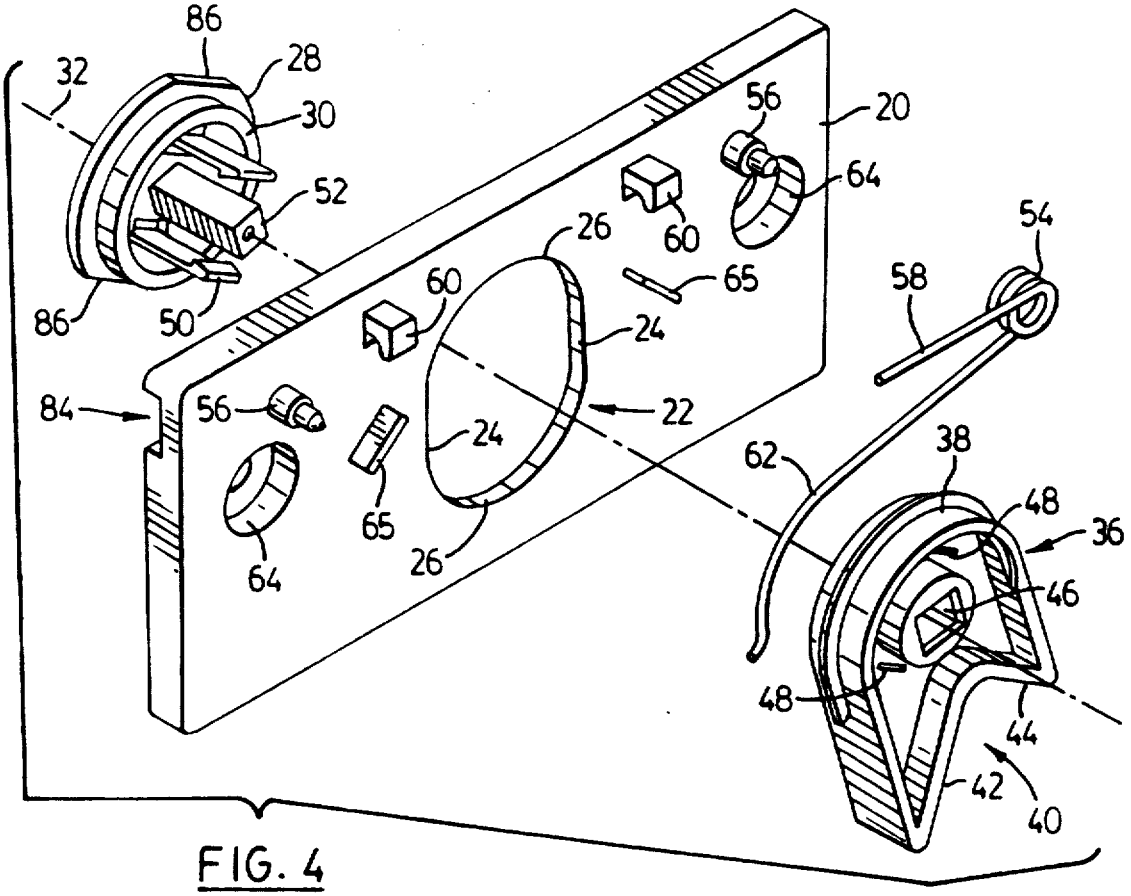
FIG. 4, which appears on the same page as FIGS. 1A and B, is an exploded view of an assembly for an antitilt mechanism according to the present invention.
Figure 2:
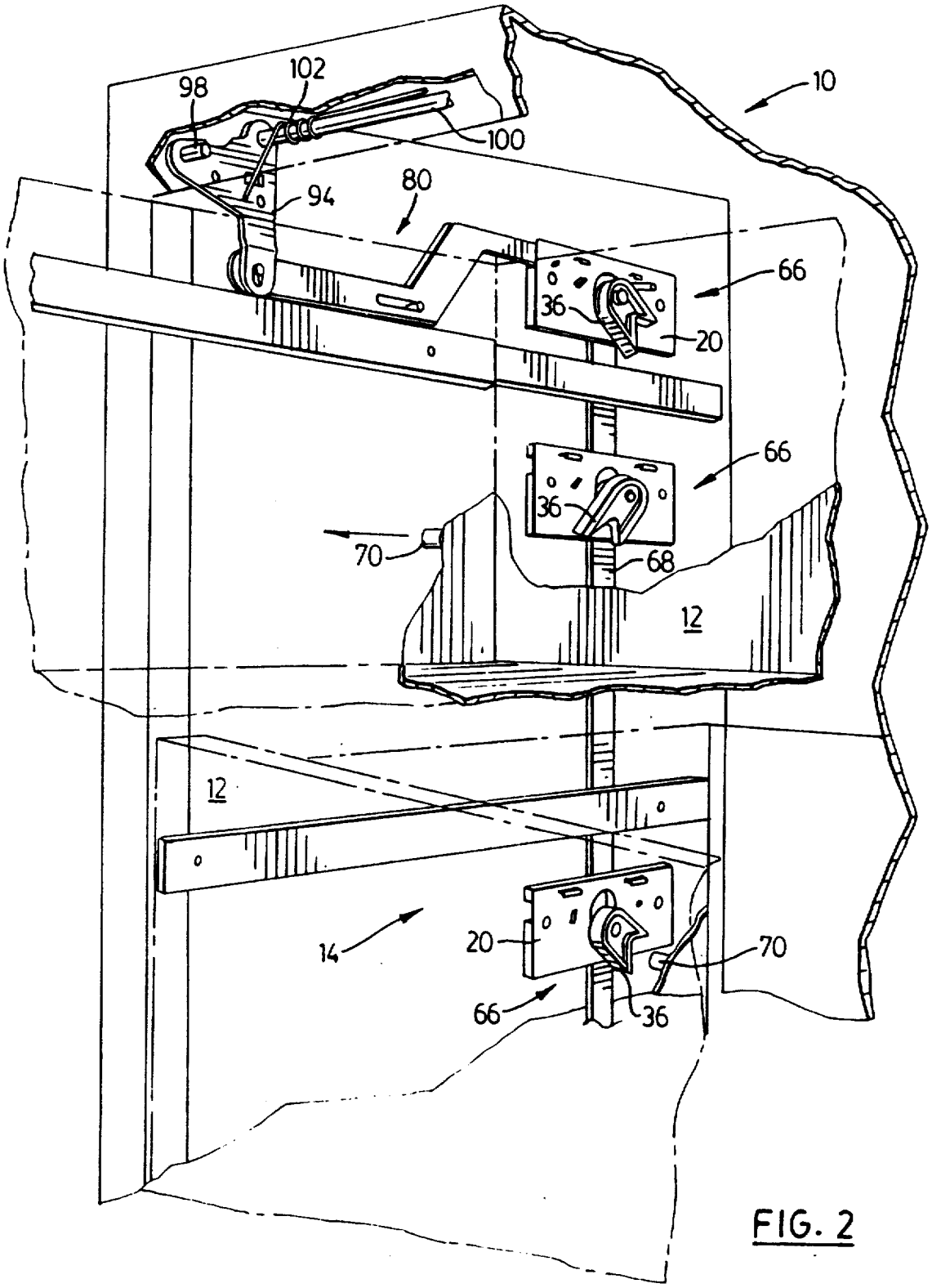
FIG. 2 is a partially cutaway view looking into a filing cabinet in the direction of the arrow 2 in FIG. 1 A.
Figure 3:
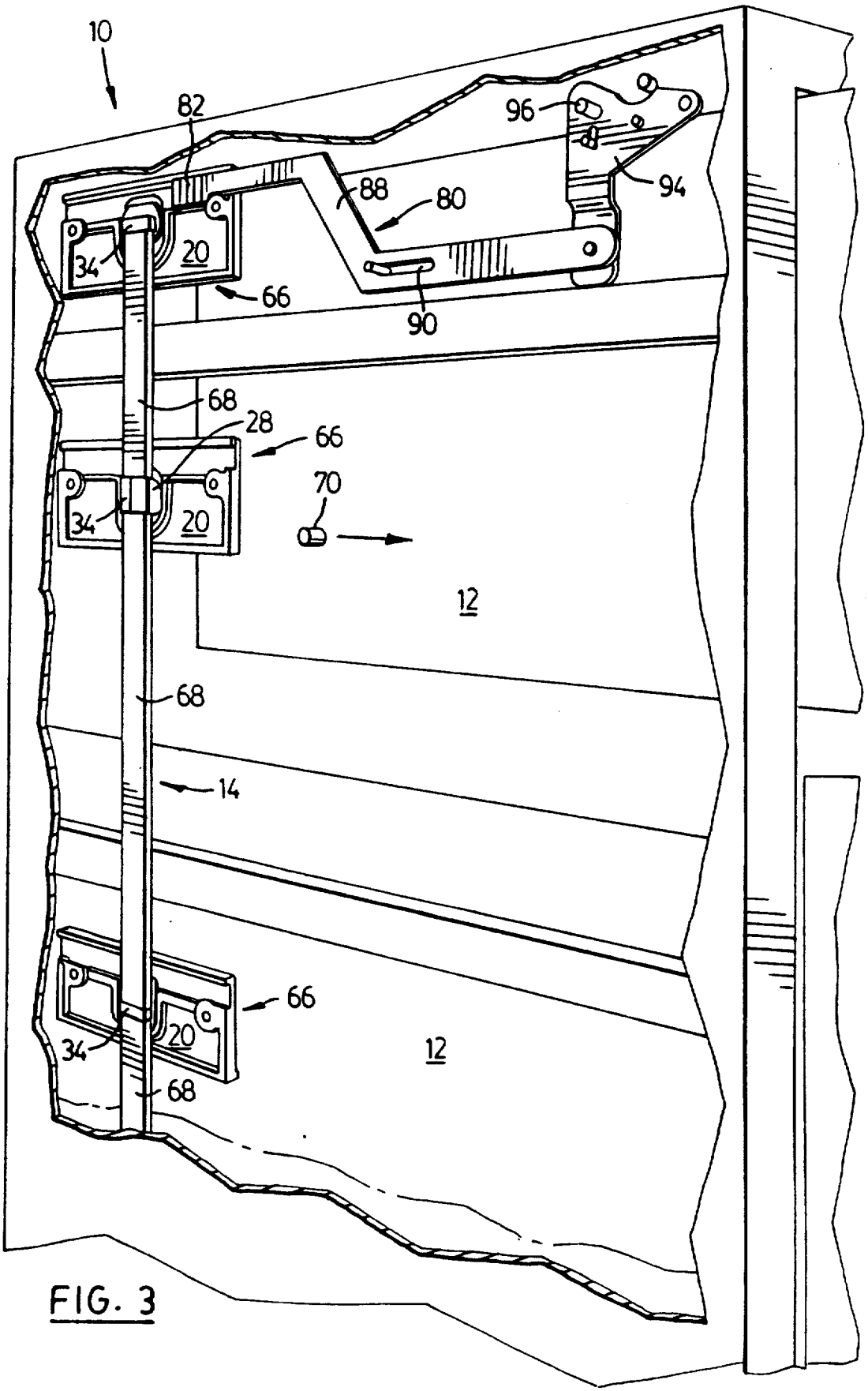
FIG. 3 is a partially cutaway view through the side of a filing cabinet in the region indicated by the arrow 3 in FIG. 1 B.
Figure 5:
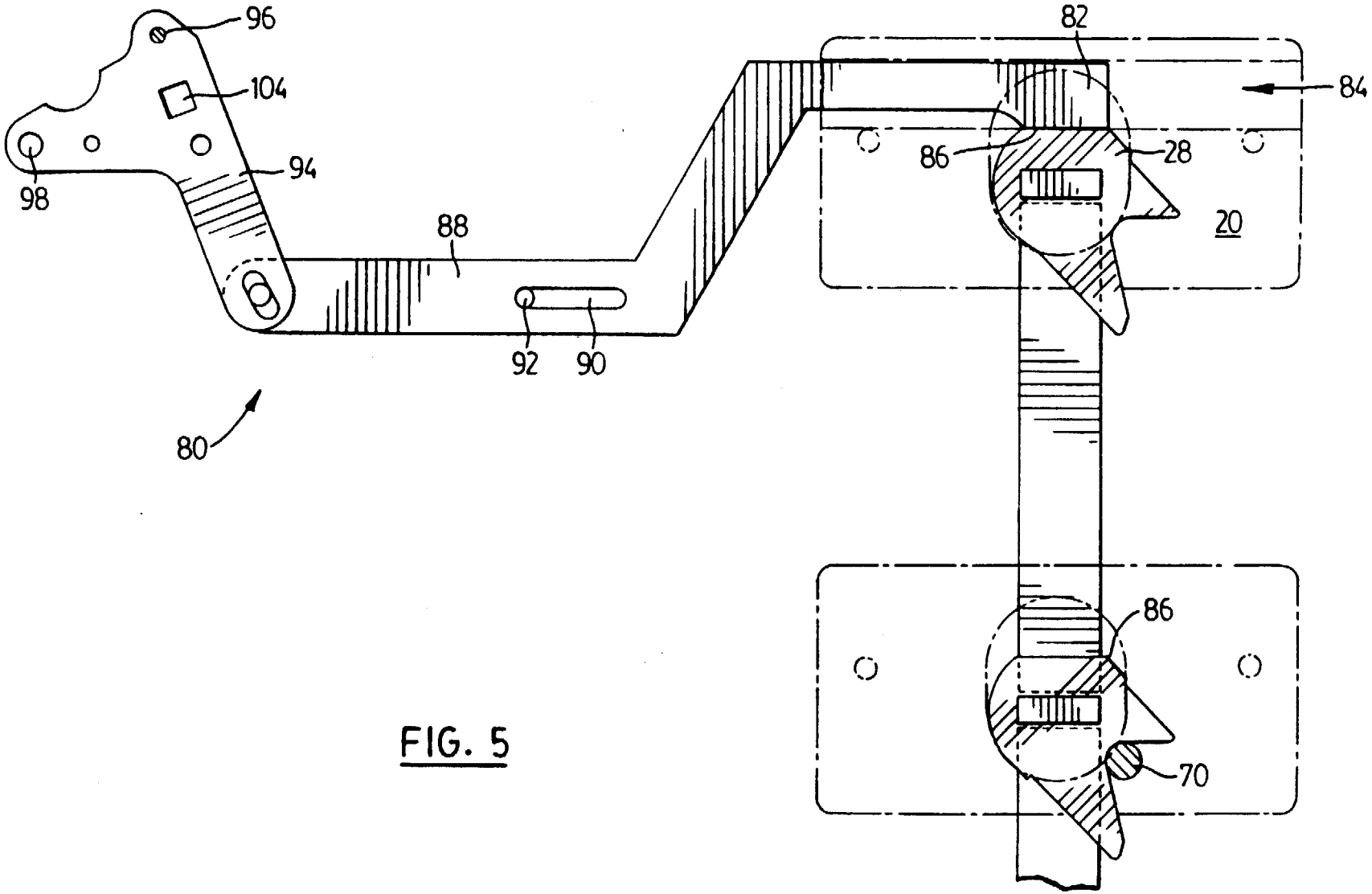
FIG. 5 is a front elevation of the upper portion of an anti-tilt mechanism according to the present invention showing the stop means engaged.

Referring now to FIGS. 2, 3 and 4, the anti-tilt mechanism has a number of generally rectangular housings 20. The housings have an elliptical opening 22 extending therethrough having opposed generally parallel sides 24 and opposed rounded ends 26. A generally disc shaped member 28 is mounted across the opening 22 on one side of the housing 20. The disc shaped member 28 has a generally cylindrical projection 30 extending from it and into the opening 22. The cylindrical projection 30 is vertically slidable within the opening 22 between the ends 26 and is further rotatable about an axis 32 generally coaxial with the axis of the cylindrical projection 30.

A generally rectangular locking cam 34, in FIG. 3, extends from the face of the disc shaped member 28 which is opposite that from which the generally cylindrical projection 30 extends. The operation of the locking cam will be discussed in more detail below.

Attaching to the disc shaped member 28 but on the opposite side of the housing 20 is an actuating means 36. The actuating means 36 is rounded at one end 38 and has a generally V-shaped notch 40 extending into the opposite end. The V-shaped notch 40 respectively defines first and second fingers 42 and 44. The actuating means 36 has a generally rectangular socket 46 extending through it, the opening 46 being generally co-axial with the axis of the rounded end 38. Generally rectangular slots 48 are provided on either side of the rectangular socket 46. The slots 48 receive and engage pronged tabs 50 which extend from the disc shaped member 28 through the opening 24 to secure the disc shaped member 28 to the actuating means 36. A generally rectangular protrusion 52 further extends from the disc shaped member 28 and is received within the rectangular socket 46 in the actuating means 36. The rectangular protrusion and the socket ensure proper alignment of the disc shaped member 28 and the actuating means 36 during assembly and also act to rotationally couple the disc shaped member 28 to the actuating means 36.

The opposed faces of the disc shaped member 28 and the actuating means 36 act together with the tabs 50 and slots 48 as interacting retention means for retaining the disc shaped member 28 adjacent the housing 20.

A biasing spring 54 is mounted on a projection 56 extending from the housing 20 on the side of the housing 20 corresponding to the actuating means 36. The spring 54 has a first leg 58 which engages a hook shaped member 60 extending from the housing 20 beside the projection 56. The spring 54 has a second leg 62 which acts against the rounded end 38 of the actuating means to urge the actuating means toward the bottom of the opening 22 in the housing as viewed in FIG. 4. As will be discussed in more detail below, the individual actuating means 36 are linked through locking rods 68. Accordingly, it is possible to use a single spring 54 only on the uppermost housing 20.

In the mechanism illustrated in FIG. 4, the actuating means is made symmetrical and duplicate hooks 60 and projections 56 are provided on opposite sides of the opening 22. In this manner the assembly for the antitilt mechanism shown in FIG. 4 may be adapted for attachment to either side of the cabinet 10 simply by turning over the actuating means so that the opposite face of the actuating means faces the housing and mounting the spring 54 on the opposite side of the opening 22.

The housing 20 is provided with openings 64 through which fasteners, such as screws or rivets, may be inserted to attach the assembly to the side of the cabinet 10. The housing is further provided with generally rectangular protrusions 65 extending from the face corresponding to the actuating means 36. The protrusions 65 engage the opposed flat faces of the actuating means 36 to limit rotation of the actuating means 36.

The structure illustrated in FIG. 4 in its assembled condition will hereinafter be referred to as an "assembly" for the anti-tilt mechanism and identified by Reference 66. One of the assemblies 66 is mounted adjacent each drawer 12 in the cabinet 10. The assemblies 66 are located one above the other and generally rectangular locking rods 68 extend between the locking cams 34 of adjacent assemblies 66. The locking rods 68 are vertically slidable within suitable channels or like guide means (not shown) provided on the interior surface of the left hand side 16 of the cabinet 10. Alternatively, the face of the housings 20 facing the side 16 of the cabinet 10 may be provided with channels or grooves above and below the opening 22 which receive and act as guides for the locking rods 68.

The generally rectangular locking cams 34 extend into the space between adjacent locking rods 68. As can be seen from FIGS. 3, 5, 6 and 7, the generally rectangular locking cams 34 have a length considerably greater than their breadth. Furthermore, the locking cam has a cam axis passing through its center and generally coinciding with the axis 32 of the disc shaped member 28. Accordingly, when the disc shaped member 28 is rotated about the axis 32, the cam 34 will rotate about its cam axis from an inactivated position as shown in the lower assembly 66 of FIG. 6 to an activated position as shown in the lower assembly 66 of FIG. 7. In the inactivated position the longer dimension of the cam 34 is generally horizontal. In the activated position the longer surface of the cam 34 is generally vertical.

Rotating the cam 34 from the inactivated position to the activated position causes the disc shaped member 28 of that cam to rise within the opening 22 in which it is located. The rotation of the cam into the activated position further causes the locking rods 68 thereabove to rise. The upward movement of the locking rods 68 is accommodated in each assembly 66 by the sliding of the cylindrical projections 30 extending from the disc shaped members 28 within the opening 22. The height of the openings 22 is selected so as to only accommodate the movement corresponding to the difference between the first and second effective heights of a cam. Accordingly, once one of the cams has been moved into its activated position, there is no space remaining in the anti-tilt mechanism for rotating a second cam into its activated position.

Figure 6:
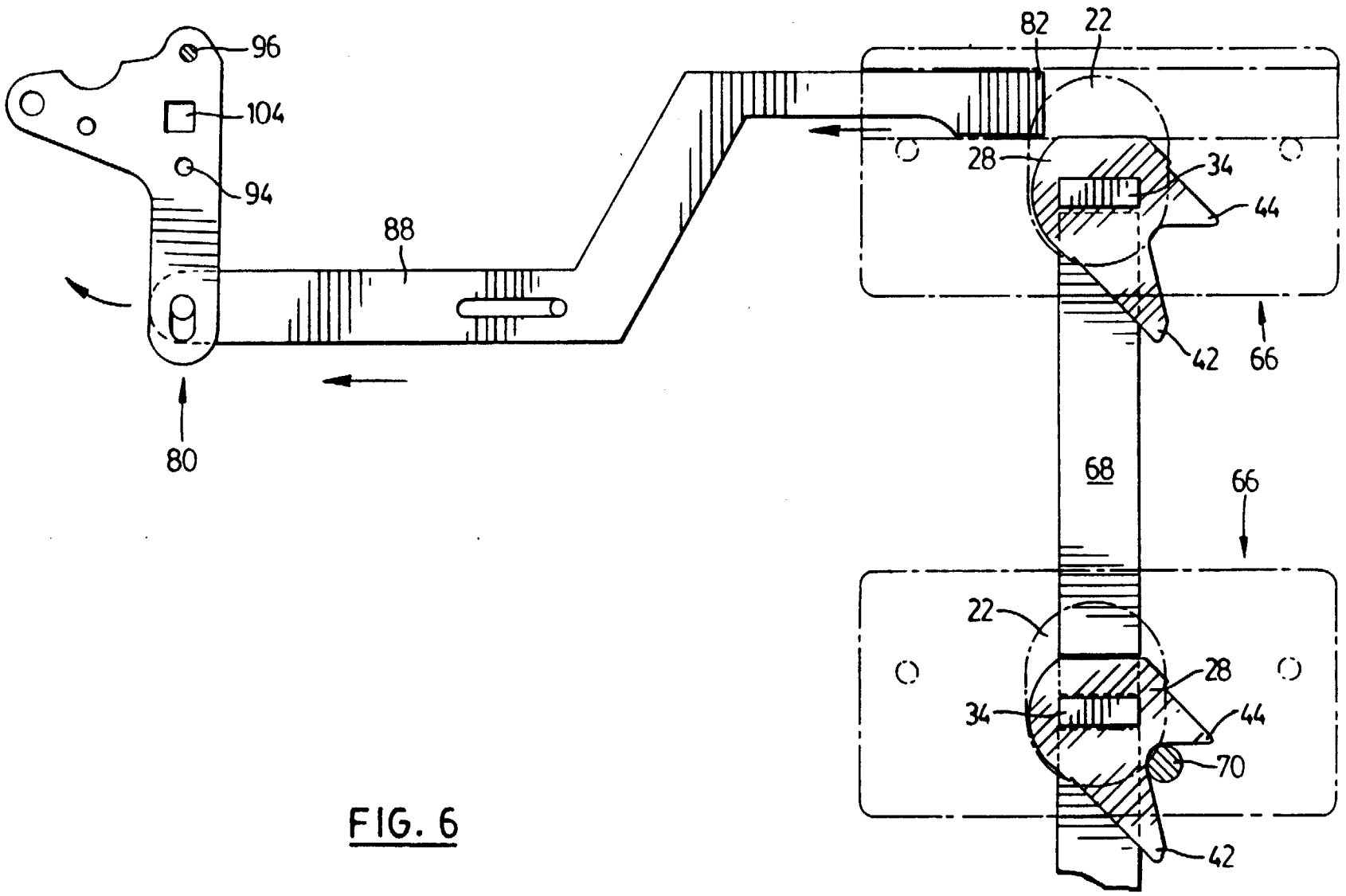
FIG. 6 is a view corresponding to FIG. 5 but showing the stop mechanism disengaged.

Rotation of the cams between the activated and inactivated position is effected by interaction between the actuating means 36 and a knob 70 projecting outwardly from the side of the file drawers 12. Referring to Figure 6, as the drawer is opened the knob 70 moves to the left striking the inside face of the first finger 42 of the actuating means 36. As the drawer is further moved to the left it presses against the first finger 42 thereby causing it to rotate the actuating means clockwise as viewed in FIG. 6 to the position shown in FIG. 7. As the actuating means 36 is rotationally coupled to the disc shaped member 30, rotation of the actuating means causes rotation of the disc shaped member which in turn causes rotation of the generally rectangular locking cam 34 projecting from the disc shaped member 28. When the drawer is closed, the knob 70 strikes the inside face of the second finger 44 to cause the actuating means to rotate anti-clockwise as viewed in FIGS. 6 and 7. This returns the actuating means from the position in FIG. 7 to that shown in FIG. 6 thereby returning the cam 34 to its inactivated position. At this point, any one of the drawers in the cabinets may be opened.

It will be appreciated that the cam and locking rod system of the present invention overcomes a problem inherent in some previous anti-tilt mechanisms in that it prevents two drawers from being opened simultaneously as there is not enough room in the anti-tilt mechanism of the present invention to turn two cams into the activated position at the same time. It will however also be appreciated that, should it be desirable, the size of the opening 22 may be selected to permit, for example, two drawers to be opened while preventing the remaining drawers from also being opened.

Figure 7:
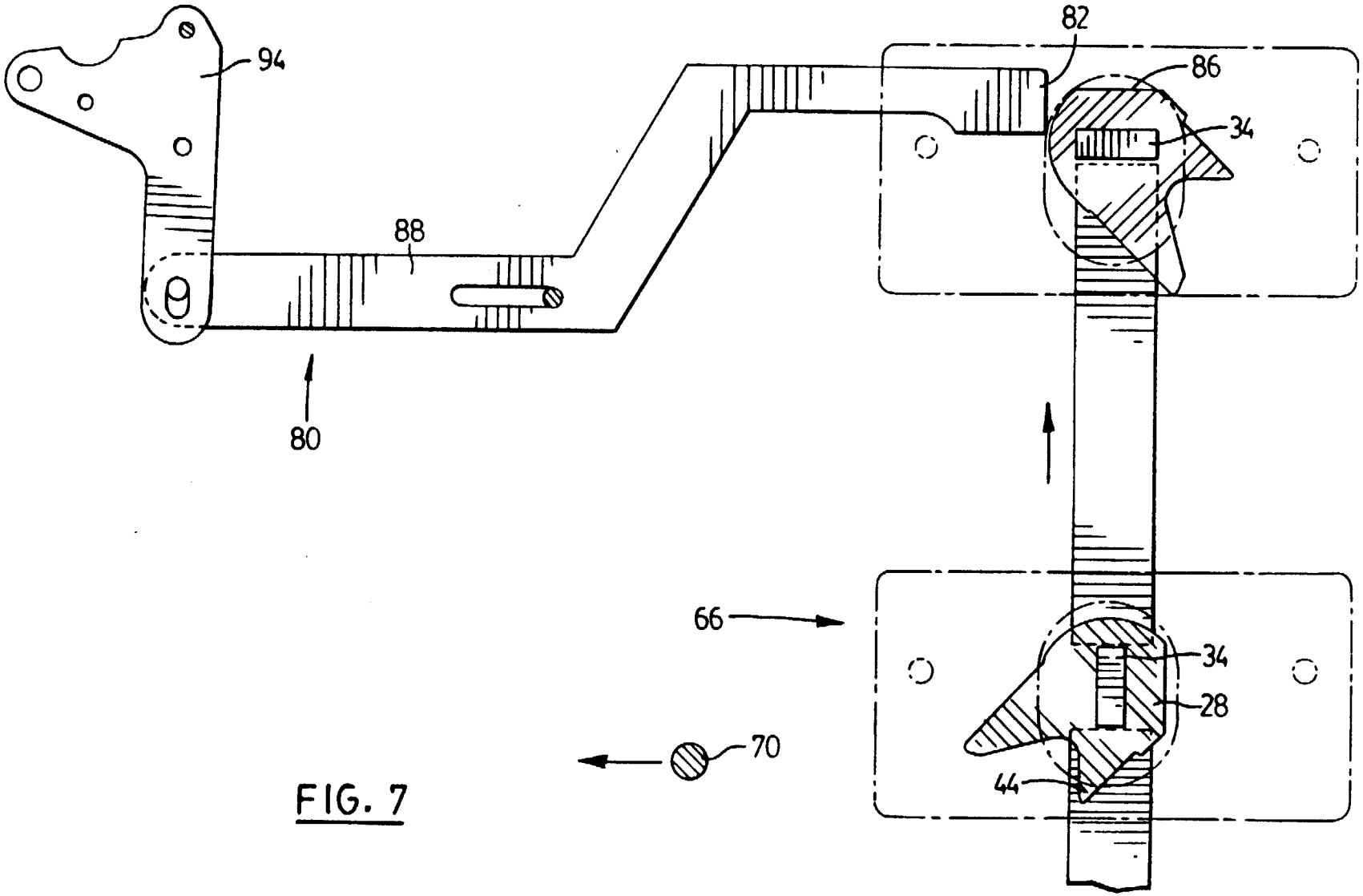
FIG. 7 is a front elevation of the upper portion of an anti-tilt mechanism according to the present invention showing a locking cam in its activated position.

A further feature of the present invention is the provision of a locking mechanism which interacts with the assemblies 66 of the anti-tilt mechanism. The locking mechanism is generally identified by reference 80 in the drawings. The locking mechanism 80 includes a generally rectangular end 82 which acts as a stop means and is laterally slidable within a channel 84 extending across the top of the housing 20 of the assembly 66 and above the generally disc shaped member 28. The stop means 82 is laterally slidable from the disengaged position as shown in FIGS. 6 and 7 to an engaged position illustrated in FIG. 5. In the engaged position the stop means 82 extends between the top of the channel 84 and the disc shaped member 28 to prevent vertical movement of the disc shaped member 28. When the stop means 82 is in the engaged position, it prevents the opening of any of the drawers below it by preventing any of the disc shaped members 28 therebelow to rise vertically which would be necessary to permit the required accompanying rotation of the locking cams from their inactivated to their activated positions.

The disc shaped members 34 may be provided with a flattened portion 86 for accommodating the end 82 of the locking mechanism 80 so that the locking mechanism may not be actuated unless the flattened portion 86 lines up with the lower part of the channel 84. In this manner, the cabinet may not be locked if any of the drawers are open.

The locking mechanism 80 has an actuating arm 88 extending away from the stop means 82. The actuating arm has an elongate slot 90 along it which receives a pin 92 extending from the side of the cabinet 10. The channel 84 in the housing 20 and the slot 90 respectively engage the stop means 82 and the pin 92 to guide the arm 88 and end 82 in its lateral movement.

Movement of the arm 88 is effected by rotation of a bell crank 94 which pivots about a pivot point 96. The bell crank would typically be linked by means common in the art to an actuating means such as a key activated lock which would cause the bell crank to move. Such a connection may include a lock engaging pin 98 extending from the bell crank 94 which may engage a similar pin orthogonal thereto and extending from the tumbler of a locking cylinder. Rotation of the locking cylinder would in turn apply pressure on the lock engaging pin 98 to cause the bell rank to rotate about the pivot 96 to cause lateral movement of the arm 88 to draw the end 82 of the locking mechanism between its engaged and disengaged positions as described above.

If anti-tilt mechanisms are provided on both sides of the cabinet, it may be desirable to have duplicate locking mechanisms, one for each side of the cabinet. To avoid the necessity of providing separate locks for each of the anti-tilt mechanisms, both of the bell cranks may be connected by a tie rod 100 in FIG. 2 extending between the respective pivot points 96 of the opposed bell cranks 94. In this manner, a single actuating mechanism may be used to rotate both bell cranks 100.

A spring 102 is coiled around the tie rod 100 adjacent each of the bell cranks 94. One end of the spring abuts the interior top of the filing cabinet 10 and the other end of the spring extends through an opening 104 in the bell crank. The spring 102 biases the guide arm 88 towards the disengaged position so that the locking mechanism will stay disengaged unless acted upon by the key activated lock or whatever alternate actuating mechanism is employed. An advantage to using the spring biased system is the degree of flexibility it gives the designer in selecting the mounting location for the mechanism which rotates the bell cranks. For example, the mechanism may be mounted in the drawer itself as the mechanism does not have to engage the pin 98 unless it is desired to lock the cabinet.

A further feature of the above locking mechanism is that it requires all of the drawers to be fully closed before the stop means 82 may be slid above the disc shaped member 28. This is a feature not inherent in many cabinet locking devices as many such devices are lockable with one or more drawers pulled out. The benefit of this feature is increased security as all the drawers must be closed to engage the locking mechanism and once the locking mechanism is engaged none of the drawers may be opened.

The spacing of the assemblies 66 will depend on the number and size of the drawers 12 of the cabinets 10. Filing cabinets typically have two depths of drawer. The drawers illustrated for example in FIGS. 2 and 3 would correspond to the deeper drawer. If the cabinet were to be fitted with shallower drawers, further assemblies 66 may be inserted mid-way between the lower two assemblies 66 in FIGS. 2 and 3. This of course would necessitate using shorter locking rods 68 such as the uppermost locking rod illustrated in FIGS. 2 and 3. The uppermost assembly 66 in FIGS. 2 and 3 as illustrated is not actuated by the knob 70 extending from the side of the drawer 12. It is included primarily for locking purposes. If a shallower drawer were fitted, the uppermost assembly 66 would also be actuated by a knob extending from the drawer for anti-tilt purposes.

Figure 8:
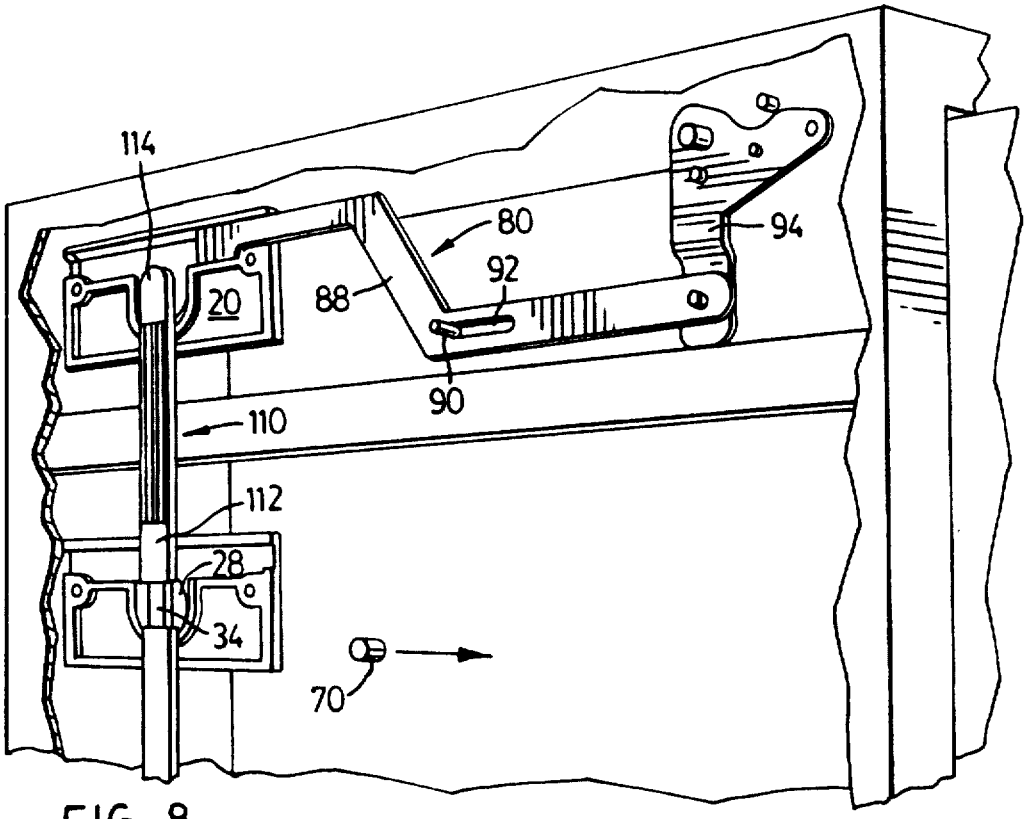
FIG. 8 is a view corresponding to FIG. 3 showing a different upper-locking rod.
Figure 9:
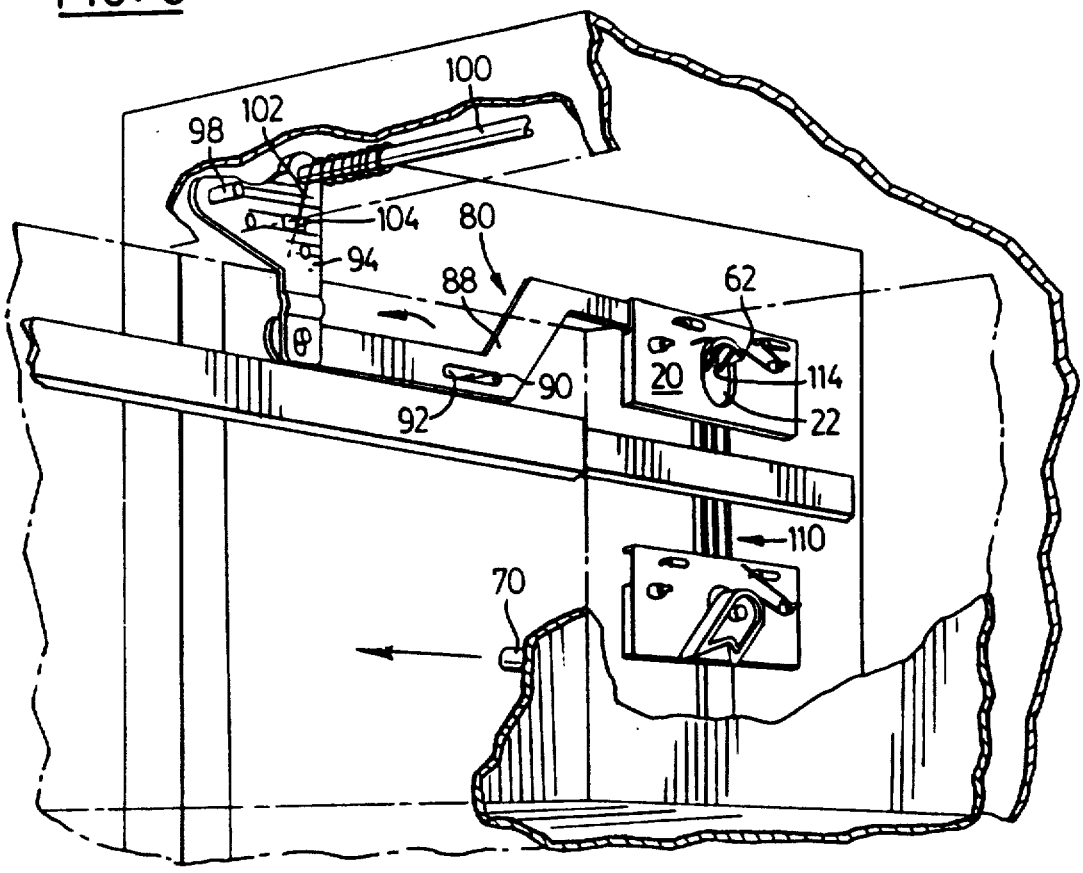
FIG. 9 is a view corresponding to FIG. 4 showing an alternate upper locking rod.

In some applications it may be desirable to eliminate the actuating means 36 from the uppermost assembly 66, for example where the uppermost assembly 66 is being used solely for locking purposes and the actuating means 36 is interfering with some of the drawer hardware. In such circumstances an alternate locking rod design identified by reference 110 in FIGS. 8 and 9 may be used. The lower portion 112 of the locking rod 110 is generally rectangular and rests within the same channel in the side of the cabinet as the remaining locking rods. The top 114 of the locking rod 110 is rounded and projects outwardly from the lower portion 112 and through the elongate opening 22 of the uppermost housing 20. The spring 62 presses against the rounded end 114 of the locking rod 110 and is retained in place by a ridge 116 in extending around the edge of the rounded portion 114.

In use, when the locking mechanism is not engaged, the locking rod 110 is moveable vertically within the opening 22 in the housing 20 until the rounded end 114 abuts the uppermost end 26 of the housing 20. When the locking mechanism is engaged, the end 82 of the arm 88 is slid above the end 114 of the locking rod 110 to prevent vertical movement of the locking rod 110 and consequently, all of the locking cams and rods therebelow.

An advantage to the anti-tilt mechanism described herein is that each of the assemblies 66 individually attaches to the side of the cabinet rather than being freely floating therein. This enables the mounting holes for the individual assemblies 66 and as well the mounting holes for the remaining components of the cabinet, for example the drawer slides, to be formed simultaneously during the cabinet manufacturing process. Accordingly, any inaccuracies in the hole placement would be consistent with the remaining holes so that the assemblies 66 would always line up with the tracks or slides for the drawers. Furthermore, a slight clearance may be left between the top of any of the locking rods 68 and the bottom of the cams 34 when they are in their inactivated position to ensure that the cylindrical projection 30 extending from the disc shaped members 28 rests against the bottom end 26 of the openings 22 in the housings 20. In this manner, slight dimensional inaccuracies in the locking rods 68 would not be additive over the entire anti-tilt mechanism. Finally, the disc shaped member 28 and the actuating means 36 are broader than the opening 22 so that the actuating means and locking cams may not be removed simply by spreading the locking rods 68 as in some of the previous devices.

Although a variety of materials may be used for the anti-tilt mechanism described herein, the assemblies 66 may be injection molded from plastic. It is preferable to use a material for the locking rods 68 which is not prone to dimensional changes upon changing humidity conditions which may have the effect of misaligning the actuating means. Also, when selecting materials for the locking cams 34 and the locking rods 68, consideration should be given to the amount of wear these parts will have on each other.

Variations to the structure and use thereof as described herein may be apparent to those skilled in the art of anti-tilt mechanisms and cabinets. Insofar as such variations are within the spirit and scope of the appended claims it is intended that they be included in the present invention.

I claim:

1. An anti-tilt mechanism for a multi-drawer cabinet, said mechanism comprising:

a plurality of housings each defining an elongated opening;

a respective locking cam mounted in each said opening and rotatable about a respective cam axis from an inactivated position wherein said cam has a first effective height to an activated position wherein said cam has a second effective height, said cam being displaceable along said opening a predetermined distance limited by the ends of said opening, said predetermined distance corresponding to an integral multiple of the difference between said first and second effective heights;

activating means reacting to movement of the drawers of said multi-drawer cabinet for rotating said cam between said activated and inactivated positions; and, respective locking rods each extending between adjacent pairs of said locking cams and being longitudinally moveable with said cams, said locking rods being dimensioned such that when a number of said locking cams corresponding to said integral number are in their respective activated positions, the remaining of said locking cams are prevented from rotating into their respective activated positions by a combination of the ends of said locking rods and said ends of said openings.

2. An anti-tilt mechanism as claimed in claim 1 further having a locking mechanism comprising:

stop means for limiting said displacement of at least one of said cams within its respective housing, said stop means being moveable between an engaged position interfering with said displacement and a disengaged position in which said stop means does not interfere with said displacement and, stop actuating means for moving said stop means between said engaged and disengaged positions.

3. An anti-tilt mechanism as claimed in claim 1 wherein:

said locking rods are slideably mounted in channels along at least an interior side of the cabinet;

said housings are mounted to said cabinet and extend across said channels;

said cam extends from the side of a disc shaped member into said channel;

said disc shaped member mounts said cam in said elongated opening; and, said disc shaped member and activating means have interacting retaining means for retaining said disc shaped member adjacent said housing.

4. An anti-tilt mechanism as claimed in claim 3 further having a locking mechanism for limiting said displacement of at least one of said cams within its respective housing, said locking mechanism including:

a stop means laterally slidable relative to said housing between an engaged position wherein said stop means extends across said disc shaped member to limit said displacement of said disc shaped member and a disengaged position wherein said stop means does not interfere with said displacement of said disc shaped member;

a key activated actuating mechanism for moving said stop means between said engaged and disengaged positions.

5. An anti-tilt mechanism as claimed in claim 4 wherein said actuating mechanism includes:

a bell crank pivotally coupled to said bar and to said cabinet;

an actuating arm extending between said bell crank and said stop means;

biasing means acting between said bell crank and said cabinet to urge said stop means towards its disengaged position; and an actuating pin projecting from said bell crank for connecting said bell crank to the tumbler of a lock.

6. An opposed air of anti-tilt mechanisms as claimed in claim 5 having the respective bell cranks of each said stop means rotationally coupled by a tie rod extending therebetween.

7. An anti-tilt mechanism as claimed in claim 3 further having a locking mechanism including:

an upper rod extending upwardly from the uppermost of said cams and slideably mounted in said channel;

a housing having an opening slideably receiving the upper end of said upper rod, the displacement of said rod being limited by abutment with an end of said opening;

a stop means laterally slideable relative to said housing between an engaged position wherein said stop means extends across the upper end of said upper rod to limit said displacement of said rod and a disengaged position wherein said stop means does not interfere with said displacement of said rod; and an actuating mechanism for moving said stop means between said engaged and disengaged positions.

8. An anti-tilt mechanism as claimed in claim 7 wherein said actuating mechanism includes:

a bell crank pivotally coupled to said bar and to said cabinet;

an actuating arm extending between said stop means and said arm;

biasing means acting between said bell crank and said cabinet to urge said stop means toward its disengaged position; and an actuating pin projecting from said bell crank for connection of said bell crank to the tumbler of a lock.

9. An opposed pair of anti-tilt mechanism as claimed in claim 8 having the respective bell cranks of each stop means rotationally coupled by a tie rod extending therebetween.

10. An anti-tilt mechanism as claimed in claim 2, 4, 5, 6, 7, 8, or 9 wherein said stop means is a bar and said stop means limits the displacement of an uppermost of said cams.

11. An anti-tilt mechanism as claimed in claim 1, 3, 2, 4, 5, 6, 7, 8 or 9 further having biasing means for urging said locking rods into a lowered position.

12. An anti-tilt mechanism as claimed in claim 3, 2 or 4 further having a spring acting between at least the uppermost housing and the disc shaped member contained therein to urge said disc shaped member toward the lowermost part of said respective opening.

13. An anti-tilt mechanism as claimed in claim 7, 8 or 9 further having a spring acting between said rod and its housing to urge said rod away from a top end of said opening.

14. An anti-tilt mechanism as claimed in claim 1, 3, 2, 4, 5, 6, 7, 8, or 9 in combination with a multi-drawer cabinet wherein said drawers of said cabinet have respective knobs projecting therefrom which engage respective of said activating means during movement of said drawers to cause said rotation of said activating means.

* * * * *